US007296709B1

(12) United States Patent
Anderson

(10) Patent No.: US 7,296,709 B1
(45) Date of Patent: Nov. 20, 2007

(54) FLUID DISPENSING SYSTEM

(76) Inventor: Harlan D. Anderson, 1233 NW. 2nd St., Box 462, Madison, SD (US) 57042

( * ) Notice: Subject to any disclaimer, the term of this patent is extended or adjusted under 35 U.S.C. 154(b) by 0 days.

(21) Appl. No.: 10/684,839

(22) Filed: Oct. 14, 2003

Related U.S. Application Data

(63) Continuation-in-part of application No. 09/965,010, filed on Sep. 27, 2001, now Pat. No. 6,640,997.

(51) Int. Cl.
*B67D 5/12* (2006.01)

(52) U.S. Cl. ..... 222/75; 222/74; 222/2; 141/59

(58) Field of Classification Search ..... 222/74, 222/75, 2, 66, 642, 180, 73, 529, 530, 333, 222/372, 383.1–383.2; 141/59
See application file for complete search history.

(56) References Cited

U.S. PATENT DOCUMENTS

| | | | | | |
|---|---|---|---|---|---|
| 264,471 | A | * | 9/1882 | Rowan et al. | 408/150 |
| 1,913,128 | A | | 6/1933 | Peter | |
| 3,318,732 | A | | 5/1967 | French et al. | |
| 3,570,644 | A | | 3/1971 | Booth | |
| 3,845,848 | A | * | 11/1974 | Robbins | 194/206 |
| 3,895,268 | A | | 7/1975 | May et al. | |
| 4,070,074 | A | | 1/1978 | Rohme | |
| D272,628 | S | | 2/1984 | Monigle et al. | |
| D273,790 | S | | 5/1984 | Monigle et al. | |
| 4,726,492 | A | | 2/1988 | Komukai | |
| 4,880,144 | A | | 11/1989 | Shea | |
| 5,018,645 | A | | 5/1991 | Zinsmeyer | |
| 5,110,010 | A | * | 5/1992 | Smith | 222/75 |
| 5,344,046 | A | * | 9/1994 | Maldanis et al. | 222/2 |
| 5,497,914 | A | | 3/1996 | Maltsis | |
| 5,685,435 | A | | 11/1997 | Picioccio et al. | |
| 5,957,329 | A | * | 9/1999 | Kenney et al. | 222/1 |
| 5,967,366 | A | * | 10/1999 | Cason | 222/2 |
| 6,061,989 | A | | 5/2000 | Trivedi et al. | |
| 6,229,448 | B1 | | 5/2001 | Bennett, Jr. et al. | |
| D463,183 | S | * | 9/2002 | Tramontina | D6/515 |
| 2005/0000588 | A1 | * | 1/2005 | Webb et al. | 141/94 |

FOREIGN PATENT DOCUMENTS

| | | |
|---|---|---|
| WO | WO 00/71464 A1 | 11/2000 |

* cited by examiner

*Primary Examiner*—Frederick Nicolas
*Assistant Examiner*—Sonia N. Khaira

(57) ABSTRACT

A fluid dispensing system for providing improved freestanding capabilities and improved automatic shutoff of the system upon returning a nozzle to a nozzle holster after use. The fluid dispensing system includes a portable stand and self-contained power source. The system further includes a holster switch using a sliding panel to ensure shutoff of the system upon placement of the dispensing hose in a dispensing hose holster.

14 Claims, 20 Drawing Sheets

FLUID DISPENSING SYSTEM

CROSS-REFERENCE TO RELATED APPLICATION

The present application is a continuation-in-part of application Ser. No. 09/965,010 filed Sep. 27, 2001 now U.S. Pat. No. 6,640,997.

BACKGROUND OF THE INVENTION

1. Field of the Invention

The present invention relates to fluid dispensing systems and more particularly pertains to a new fluid dispensing system for providing improved freestanding capabilities and improved automatic shutoff of the system upon returning a nozzle to a nozzle holster after use.

2. Description of the Prior Art

Known prior art includes U.S. Pat. No. 5,967,366 issued to Cason; U.S. Pat. No. 5,957,329 issued to Kenney et al.; U.S. Pat. No. 5,018,645 issued to Zinsmeyer; U.S. Pat. No. 4,880,144 issued to Shea; U.S. Pat. No. 3,318,732 issued to French; U.S. Pat. No. 3,570,644 issued to Booth; U.S. Pat. No. 5,497,914 issued to Maltsis; U.S. Pat. No. 3,845,848 issued to Robbins; U.S. Pat. No. Des. 272,628 issued to Monigle et al.; U.S. Pat. No. Des. 273,790 issued to Monigle et al.; U.S. Pat. No. 1,913,128 issued to May et al.; U.S. Pat. No. 3,895,268 issued to May et al.; U.S. Pat. No. 4,070,074 issued to Rohme; U.S. Pat. No. 4,726,492 issued to Komukai; U.S. Pat. No. 5,685,435 issued to Picioccio et al; U.S. Pat. No. 6,061,989 issued to Trivedi et al.; U.S. Pat. No. 6,229,448 issued to Bennett et al.; and Foreign WIPO reference WO 00/71464 A1 issued to Willecke et al.

While these devices fulfill their respective, particular objectives and requirements, the need remains for a system that provides superior portability by removing reliance on a power outlet. Further, there is a need to maximize the efficiency of the system by prolonging power source life regardless of the power source being used.

SUMMARY OF THE INVENTION

The present invention generally comprises a housing, pump assembly, dispensing hose, tank, portable stand and self-contained power source. The system further includes a holster switch assembly using a sliding panel to ensure shutoff of the system upon placement of the dispensing hose in a dispensing hose holster.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
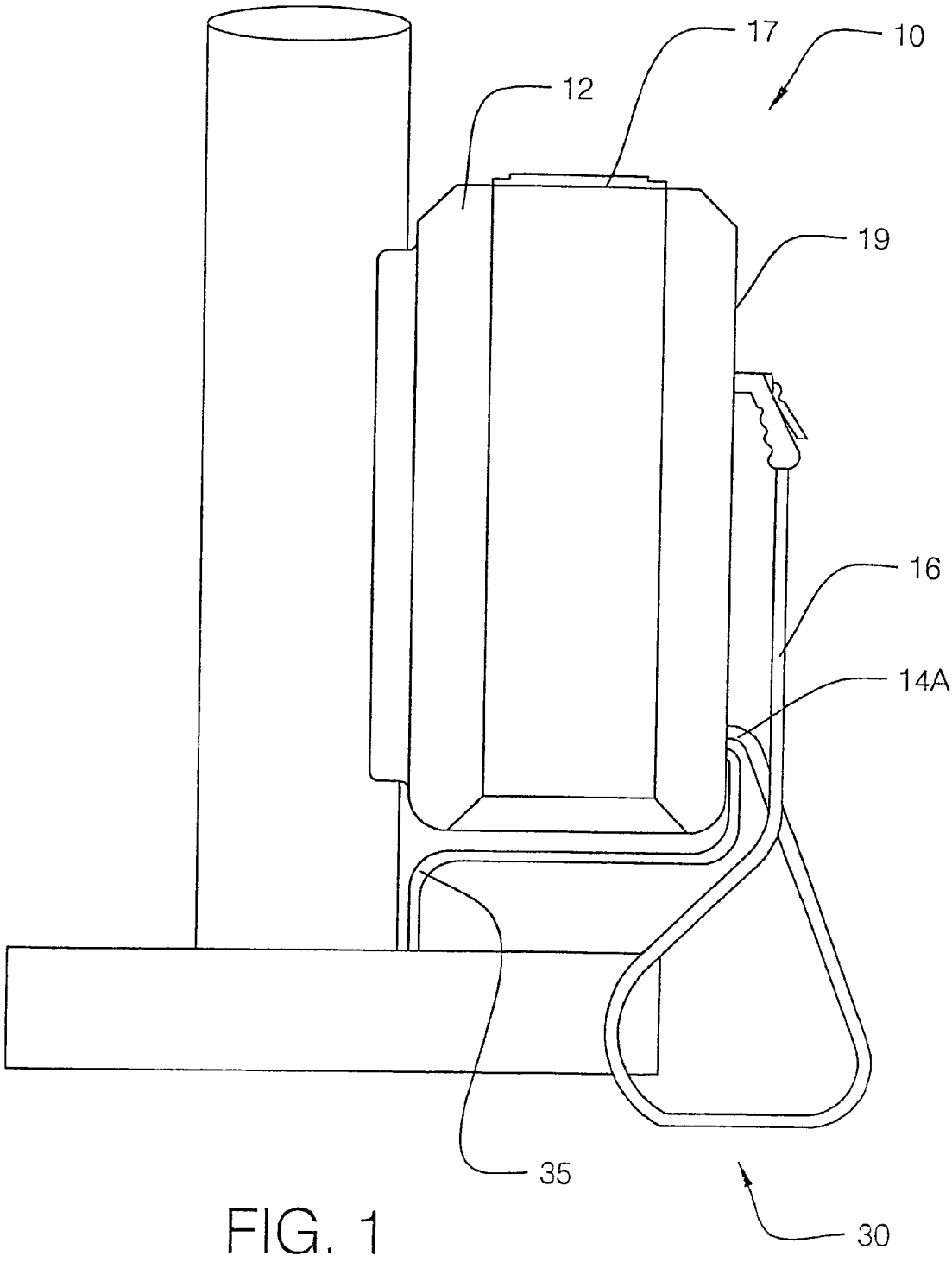
FIG. 1 is a side view of a new fluid dispensing system according to the present invention mounted to a pillar.
Figure 2:
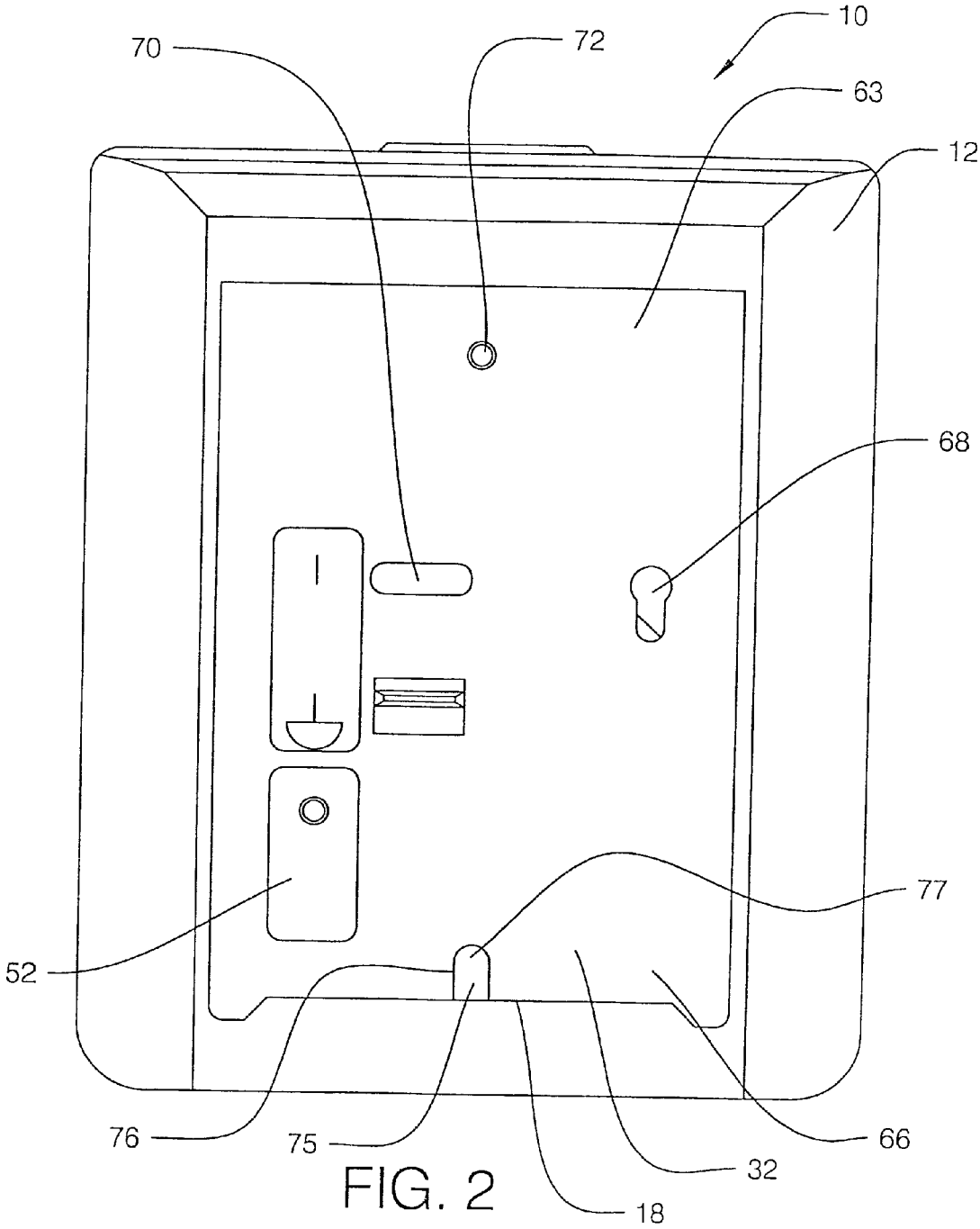
FIG. 2 is a front view of the present invention with the cover member in an open position.
Figure 3:
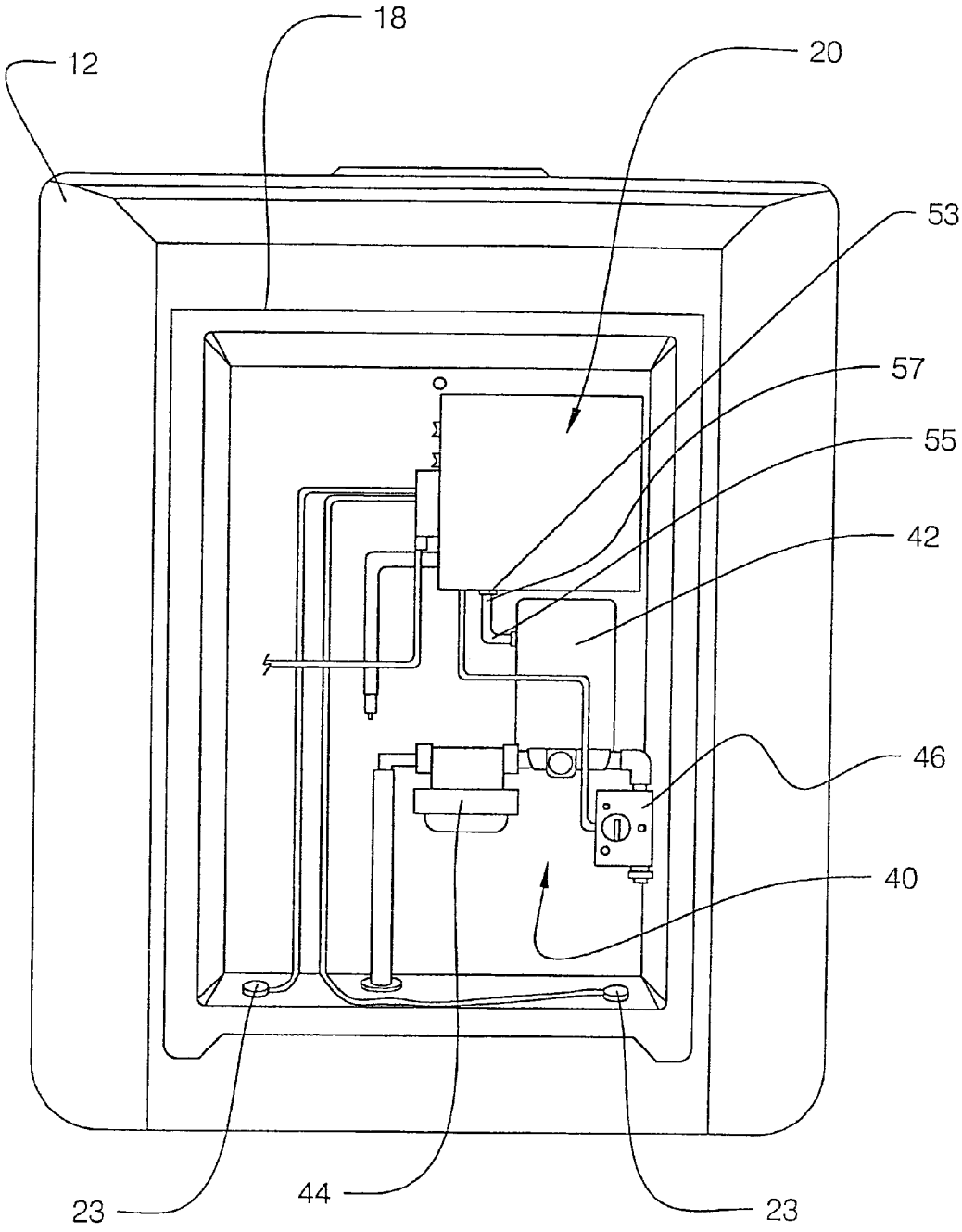
FIG. 3 is a front view of the present invention with the cover member removed.

With reference now to the drawings, and in particular to FIGS. 1 through 21 thereof, a new fluid dispensing system embodying the principles and concepts of the present invention and generally designated by the reference numeral 10 will be described.

As best illustrated in FIGS. 1 through 21, the fluid dispensing system 10 generally comprises a housing 12; a tank 14 for holding a vehicle fluid 2 such as windshield washing fluid, hydraulic brake fluid, antifreeze, soap solutions, or power steering fluid; a dispensing hose 16; and a control assembly 20. The dispensing system 10 is designed for permitting desired automatic dispensing of the vehicle fluid at a desired location of a fuel filling station. The vehicle solutions could also be any other known fluids typically used in association with automotive, farm or aviation vehicles.

The tank 14 is positioned in the housing and has an interior space designed for holding the vehicle fluid 2. The housing 12 is structured to have an opening 18 in a forward face 19 of the housing 12.

The dispensing hose 16 is part of a dispensing hose assembly 30 that is coupled to the tank 14. The dispensing hose 16 has a first end 14A in environmental communication with the interior space of the tank 14. Thus, the dispensing hose 16 is designed for dispensing the vehicle fluid 2 through the dispensing hose 16.

A pump assembly 40 includes a pump 42 and is coupled to the dispensing hose 16 for pumping the vehicle fluid 2 through the dispensing hose 16. The pump assembly 40 includes a filter 44 positioned between the tank 14 and the pump 42 for removing debris from the vehicle fluid 2. Thus, the filter 44 removes debris from the vehicle fluid 2 before the vehicle fluid 2 enters the pump 42. In an embodiment, the pump assembly 40 also includes a flow meter 46 for monitoring flow of the vehicle fluid 2 through the pump assembly 40.

The control assembly 20 is operationally coupled to the pump assembly 40 for selectively activating the pump 42. Thus, the pump 42 dispenses the vehicle fluid 2 only upon activation by the control assembly 20.

A cover member 32 is couplable to the housing 12 for covering the opening 18 in the forward face 19 such that the control assembly 20 is covered to prevent unauthorized access to the control assembly 20. A currency collection assembly 50 is operationally coupled to the control assembly 20 such that the control assembly 20 dispenses the vehicle fluid only upon reception of a pre-determined initial value of currency collected by the currency collection assembly 50. Preferably, the currency collected can be in the form of either bills or coins.

The currency collection assembly 50 includes a currency collection bin 52 coupled to the cover member 32. The currency collection bin 52 is positionable beneath a main portion 54 of the currency collection assembly 50 when the cover member 32 is engaged to the housing. Thus, currency passing through the main portion 54 of the currency collection assembly 50 is collected in the currency collection bin 52.

In a most preferred embodiment, the control assembly 20 utilizes a computer controller 59 for crediting a pre-determined number of pulses upon accumulation of a pre-determined amount of currency. Each pulse is associated with a given amount of fluid such that a desired amount of fluid can be purchased by insertion of sufficient currency. As an additional feature, the computer controller 59 is operationally coupled to the currency collection assembly to prevent acceptance of currency when the level of fluid in the tank is below a pre-determined level, thus preventing acceptance of money in excess of an amount available to be dispensed.

Alternately, the control assembly 20 may include an accumulating timer 56 for permitting dispensing of the vehicle fluid 2 for a pre-determined period of time upon reception of the initial value of currency collected by the currency collection assembly 50. In an embodiment, the currency collection assembly 50 is operationally coupled to the control assembly 20 such that the vehicle fluid 2 is dispensable for an additional pre-determined period of time upon reception of additional currency in excess of the initial value of currency collected by the currency collection assembly 50.

The opening 18 in the housing 12 has a channel 62 extending along a bottom 64 of the opening 18 for receiving a bottom 66 of the cover member 32.

In an embodiment, the cover member 32 includes a holster assembly 68 for receiving a free end of the dispensing hose 16. Typically, the free end of the dispensing hose 16 will have a pistol style attachment or other comparable nozzle with a trigger mechanism to permit a user to regulate flow of the vehicle fluid 2 through the dispensing hose 16.

A holster switch 65 is operationally coupled to the control assembly 20 for preventing dispensing of the vehicle fluid 2 upon return of the free end of the dispensing hose 16 to the holster portion 68 after use. This may be by zeroing the credited pulses when the computer controller 59 is used or by zeroing an amount of time on the accumulating timer 56.

The holster assembly 68 includes a holster opening 22 for receiving the free end of the dispensing hose 16. The holster assembly 68 also includes a sliding panel 24 movable between a receiving position and a blocking position. The blocking position is for at least partially blocking the holster opening 22. Thus, insertion of the free end of the dispensing hose 16 is prevented until the sliding panel 24 is moved from the blocking position.

The free end of the dispensing hose 16 supports the sliding panel 24 in the receiving position when the free end of the dispensing hose 16 rests in the holster opening 22.

The sliding panel 24 is vertically oriented such that gravity urges the sliding panel 24 into the blocking position.

The sliding panel 24 is coupled to an interior of the cover member 32. In an embodiment, the sliding panel 24 has an arcuate edge 26 extending across the holster opening 22 such that the sliding panel partially blocks the holster opening 22 when the sliding panel 24 is in the blocking position. Thus, insertion of the free end of the dispensing hose is made easier in that partial obstruction of the holster opening prohibits total insertion of the free end into the holster opening but permits use of an edge of the free end to move the sliding panel to permit full insertion of the free end.

The holster switch includes a main portion 67 positioned adjacent to the sliding panel 24. A switch arm 69 extends from the main portion 67. The switch arm 69 is operationally coupled to the sliding panel 24 such that movement of the sliding panel 24 between the receiving position and the blocking position moves the switch arm 69 between a use position and a shutoff position. The switch arm 69 is in the use position when the sliding panel 24 is in the blocking position to permit activation of the pump assembly 40 and use of the dispensing hose 16 when the sliding panel 24 is in the blocking position. A guide member 71 is statically positioned on an interior face of the cover member and the sliding panel 24 is secured to slide within a medial cutout portion 79 of the guide member.

A display panel 70 is coupled to the cover member 32 and is operationally coupled to the control assembly 20 for displaying either remaining amount of fluid dispensable or remaining time for dispensing the vehicle fluid 2.

A spindle lock 72 is coupled to the cover member 32 proximate a top 63 of the cover member 32. The spindle lock 72 has a threaded interior end portion 73 selectively engageable to a brass socket 82 coupled to an interior wall 74 of the housing 12 for locking the cover member 32 to the housing 12. In use, the spindle lock 72 secures the top portion of the cover member 32 while the bottom 66 of the cover member 32 is held within the channel 62 to prevent the cover member 32 from being removed.

In an embodiment, the cover member 32 has orthogonal side portions 60 for seating in a recessed lip 61 of the housing 12 to prevent prying of the cover member 32 from the housing 12 when the cover member 32 is secured to the housing 12. The orthogonal side portions 60 can be provided by bending edges of the cover member 32 forwardly to a 90 degree angle with respect to an interior portion of the cover member 32.

In an embodiment, the channel 62 in the opening 18 of the housing 12 has a protrusion 75. The bottom 66 of the cover member 32 has a notch 76 for receiving the protrusion 75 when the cover member 32 is coupled to the housing 12. The notch 76 extends upwardly into the cover member 32 such that an upper portion 77 of the notch 76 receives the dispensing hose 16 therethrough when the cover member 32 is coupled to the housing 12.

In an embodiment, a transmitter 78 is operationally coupled to the control assembly 20 for transmitting status data to a remote location for monitoring use of the fluid dispensing system 10.

A tank fluid level sensor 23 is coupled to the tank 14 for monitoring a level of the vehicle fluid 2 in the tank 14. The tank level sensor 23 is operationally coupled to the control assembly 20 such that the transmitter 78 transmits a refilling signal to the remote location upon detection of a predetermined level of fluid in the tank 14.

The tank 14 has a fill opening 15 positioned on a top surface 17 of the tank 14. A perimeter edge of the fill opening 15 is molded to engage a cap member 25 that is selectively engageable to the fill opening 15 for covering the fill opening 15. In an embodiment, the cap member 25 has a locking mechanism 27 for preventing removal of the cap member 25 for facilitating access to the tank 14 only by authorized persons for maintenance of the fluid dispensing system 10.

Figure 4:
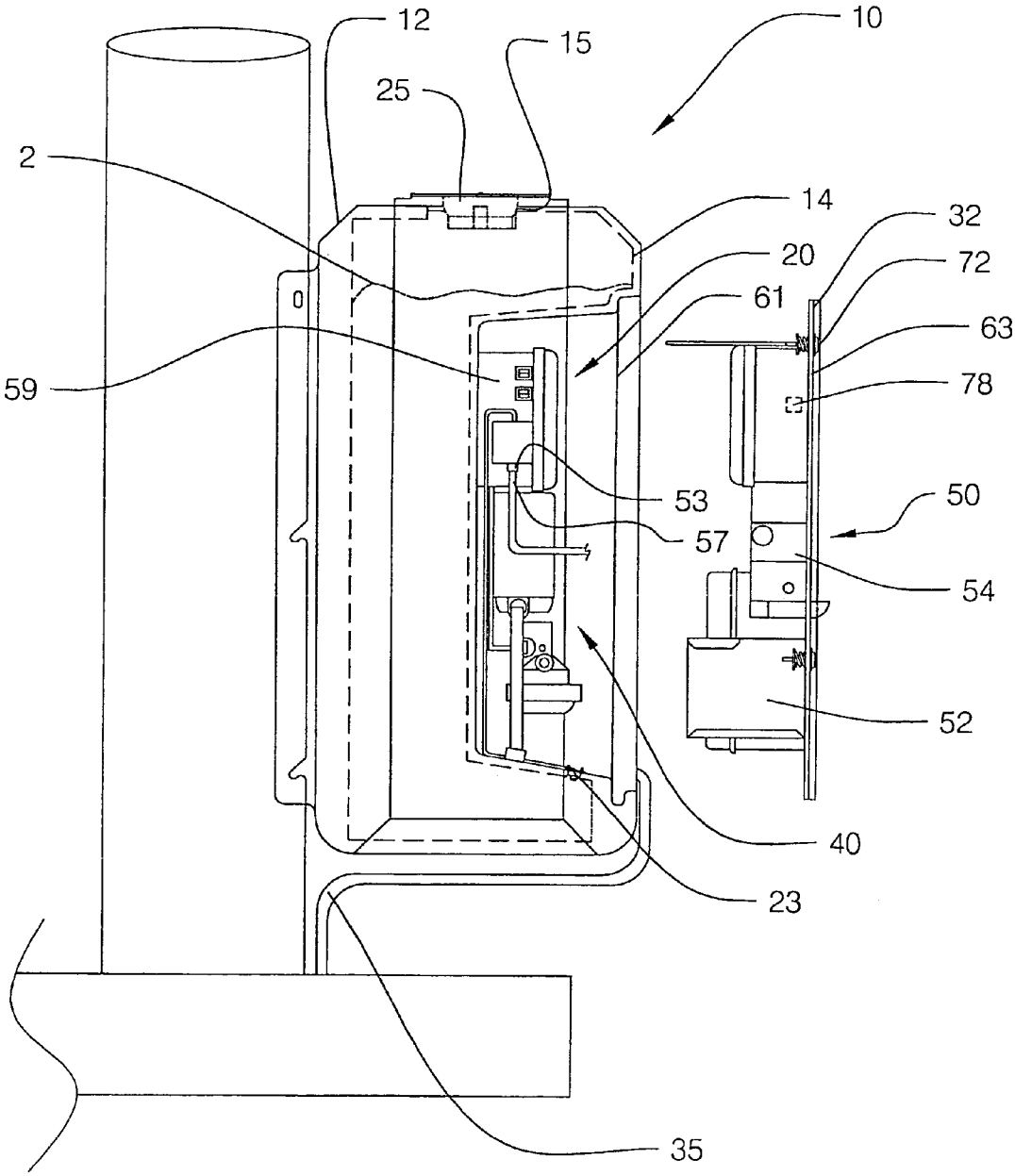
FIG. 4 is a side exploded view of the present invention mounted to a pillar.
Figure 5:
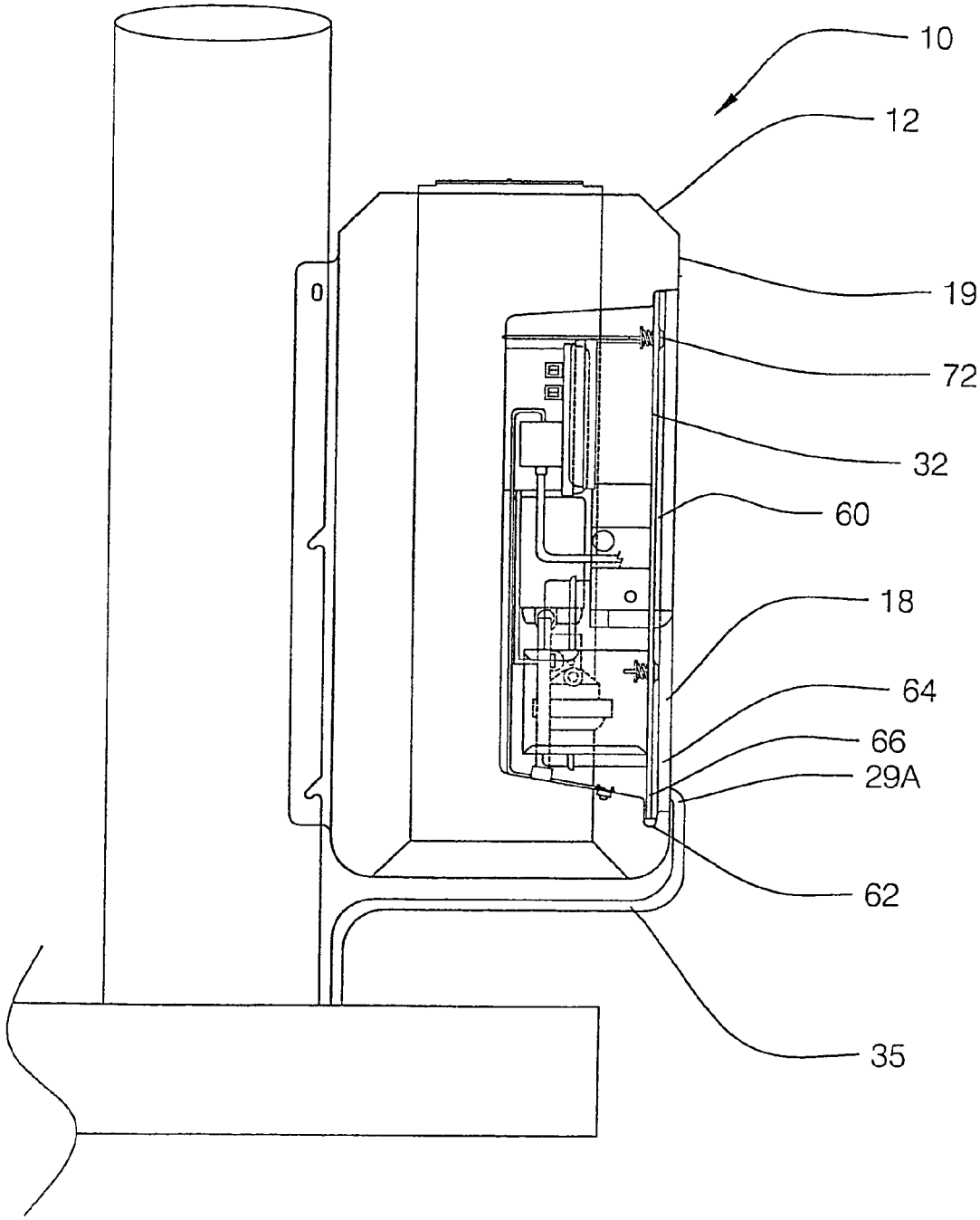
FIG. 5 is a cross-sectional view of the present invention.
Figure 6:
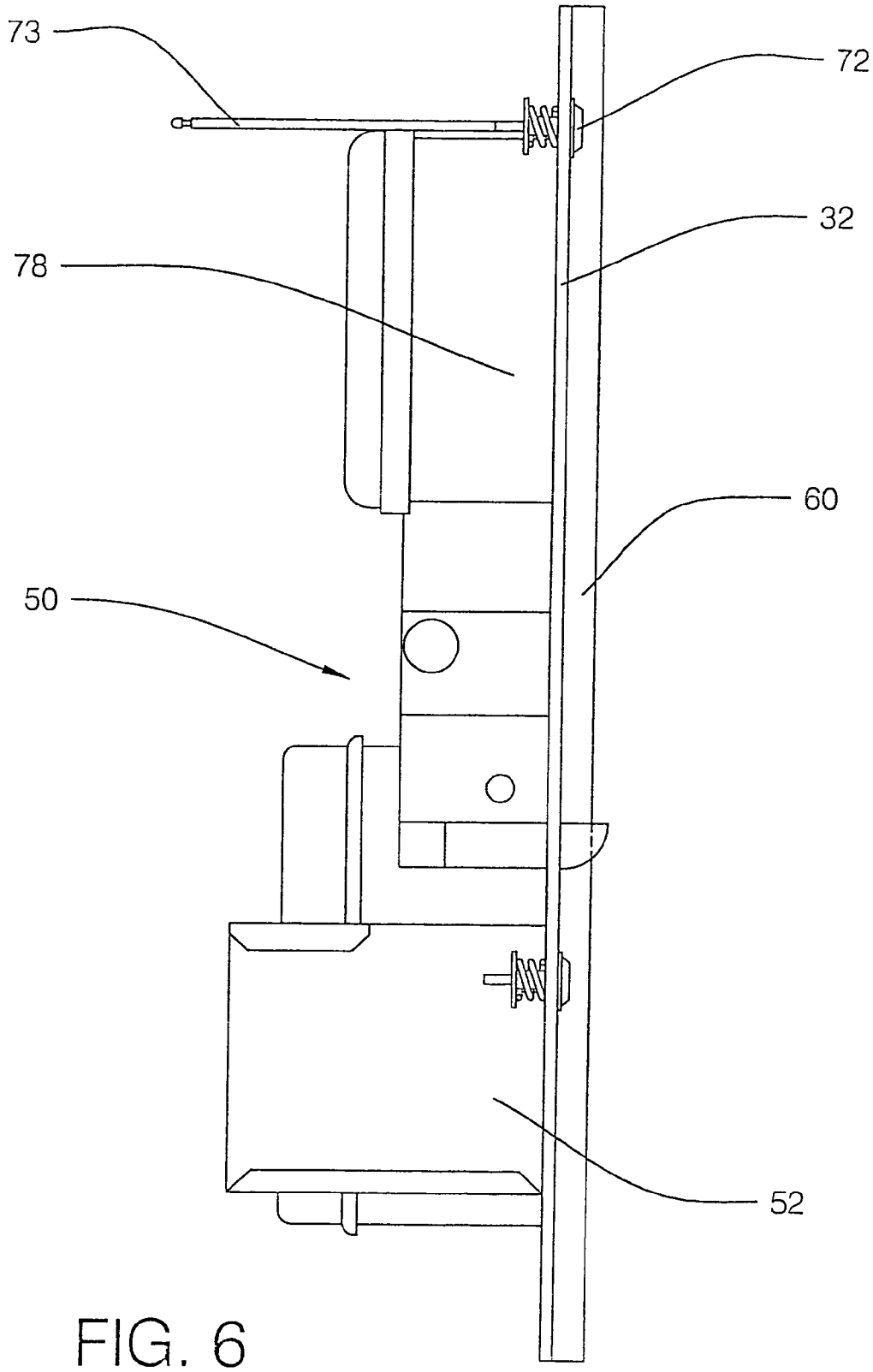
FIG. 6 is an enlarged side view of the cover member of the present invention.
Figure 7:
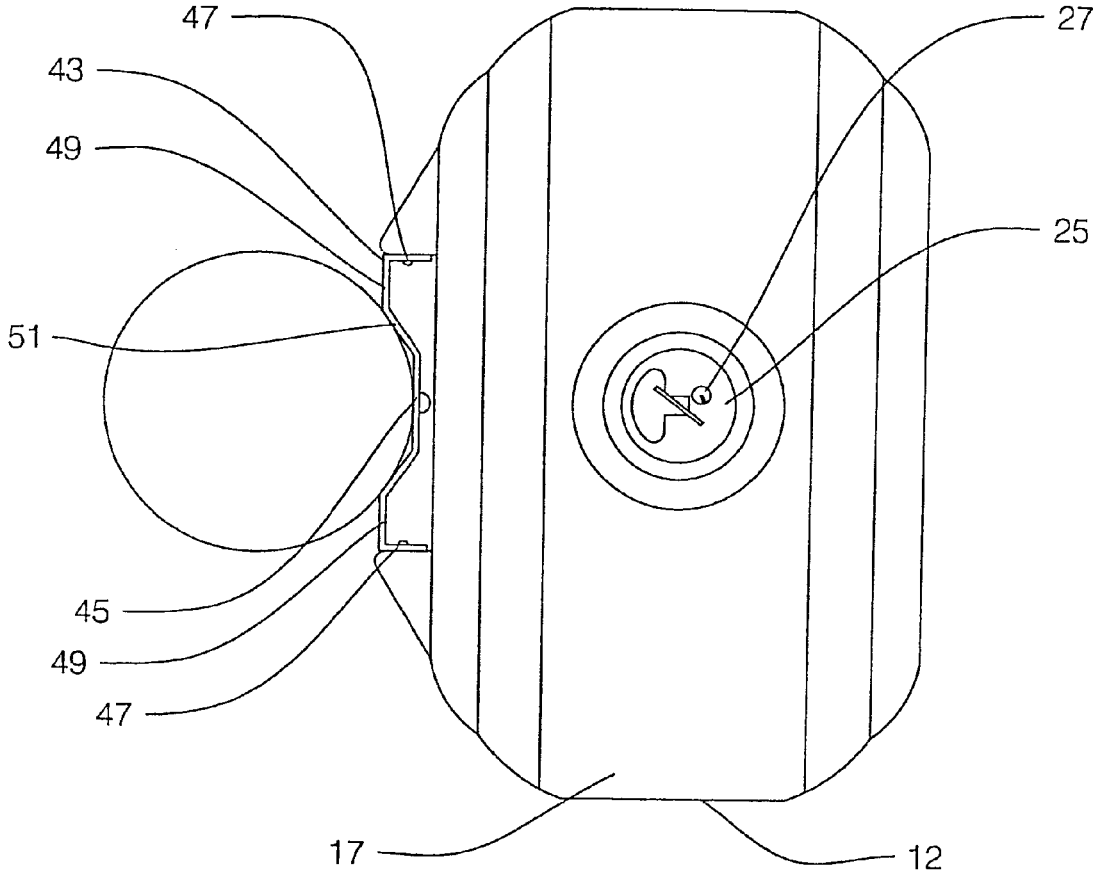
FIG. 7 is a top view of the present invention mounted to a pillar.
Figure 8:
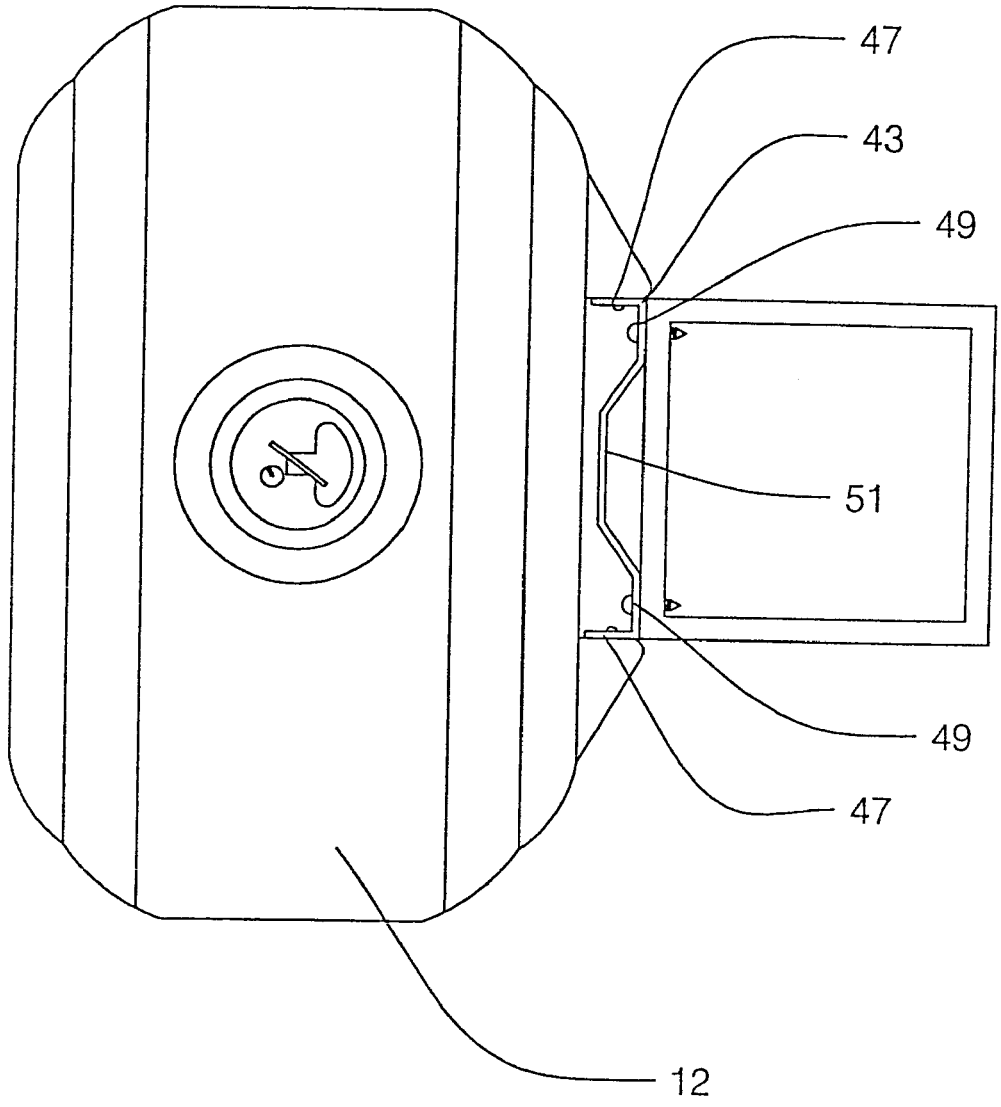
FIG. 8 is a top view of the present invention mounted to an alternate pillar.
Figure 9:
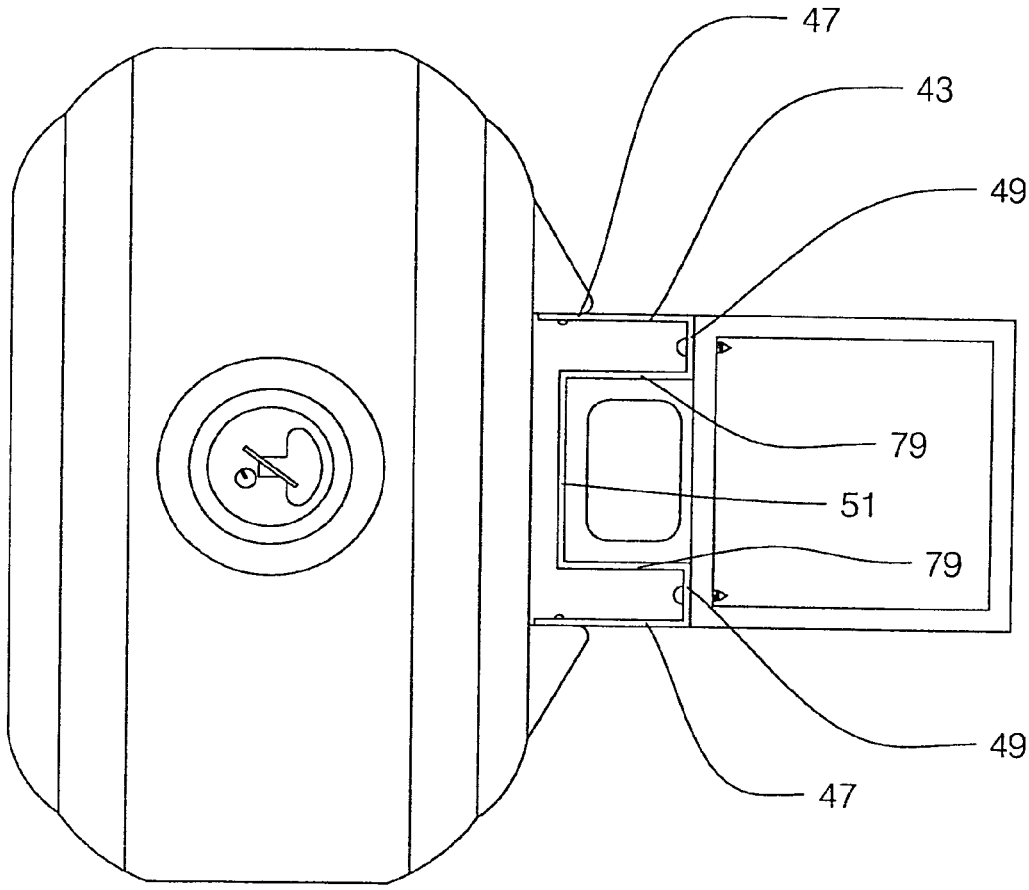
FIG. 9 is a top view of alternate embodiment of the mounting bracket of the present invention mounted to a pillar.
Figure 10:
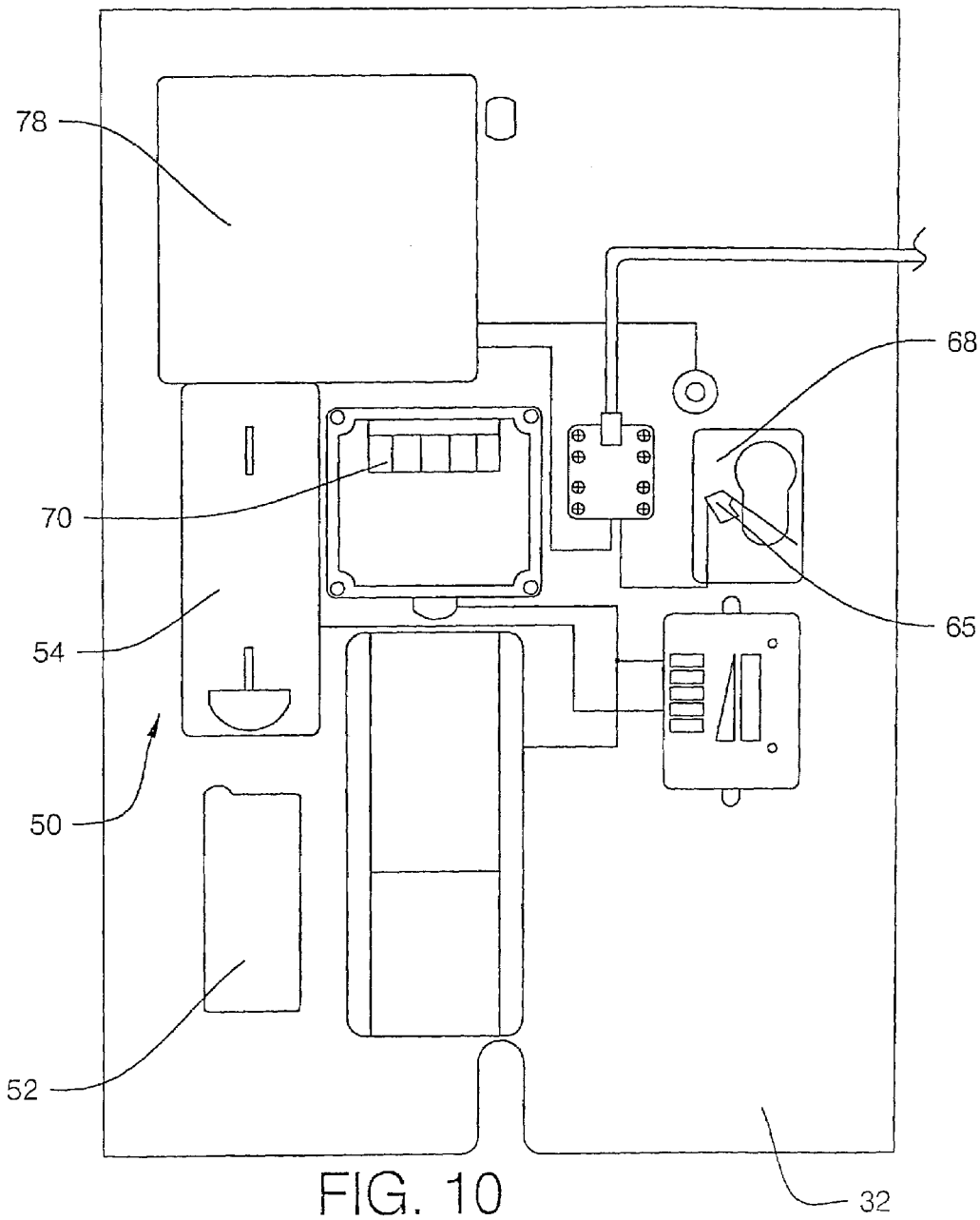
FIG. 10 is a schematic view of the cover member of the present invention.
Figure 11:
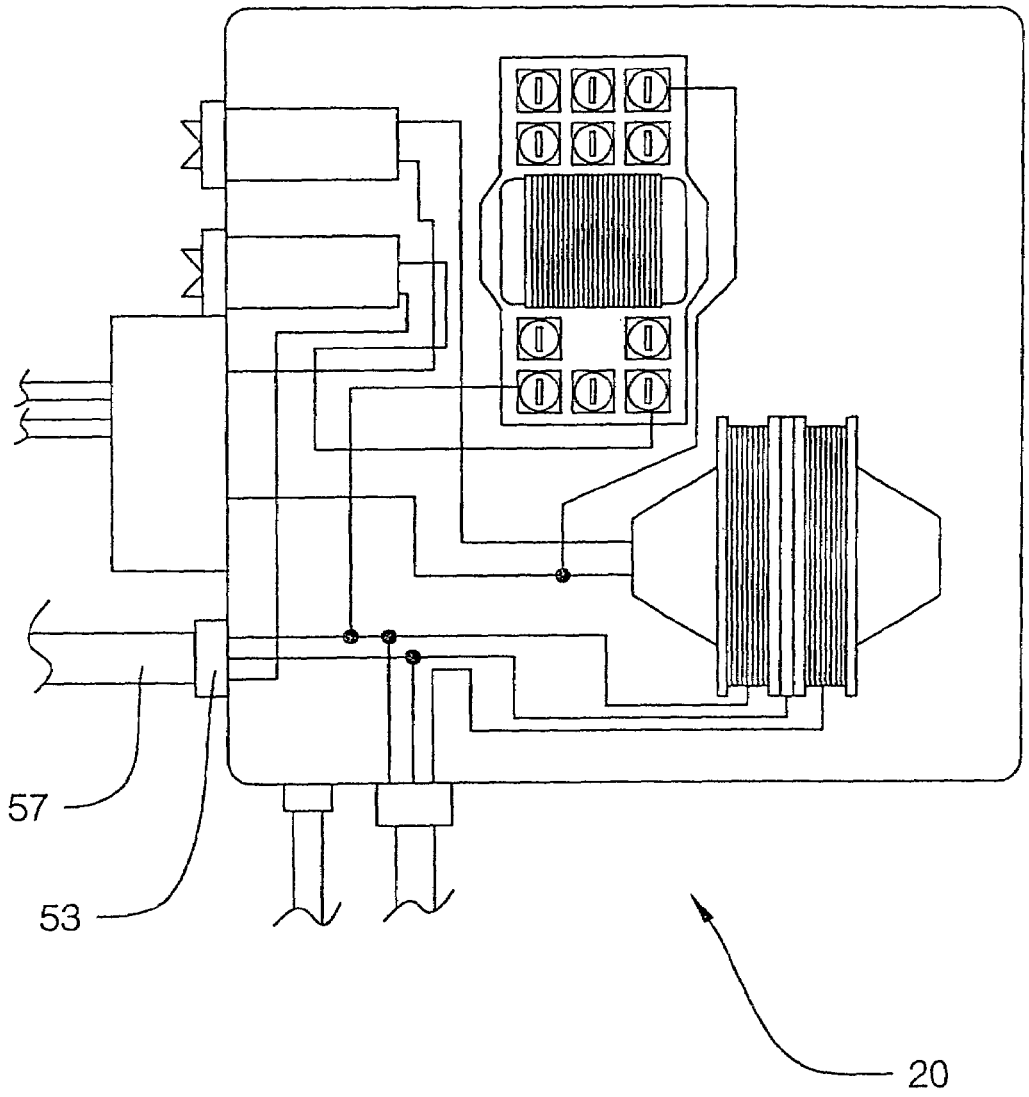
FIG. 11 is a schematic view of the control assembly of the present invention.
Figure 12:
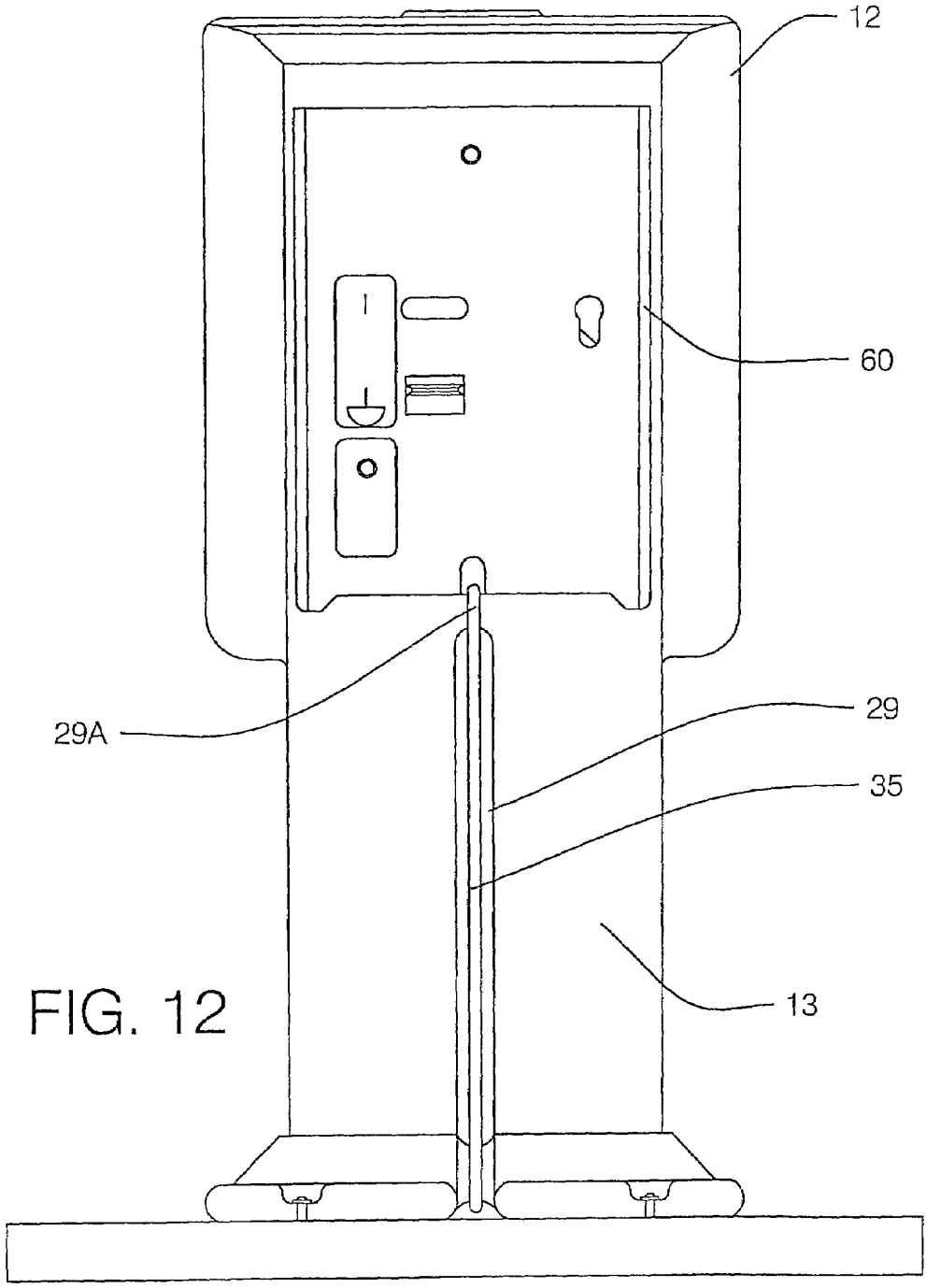
FIG. 12 is a front view of an alternate embodiment of the present invention.
Figure 13:
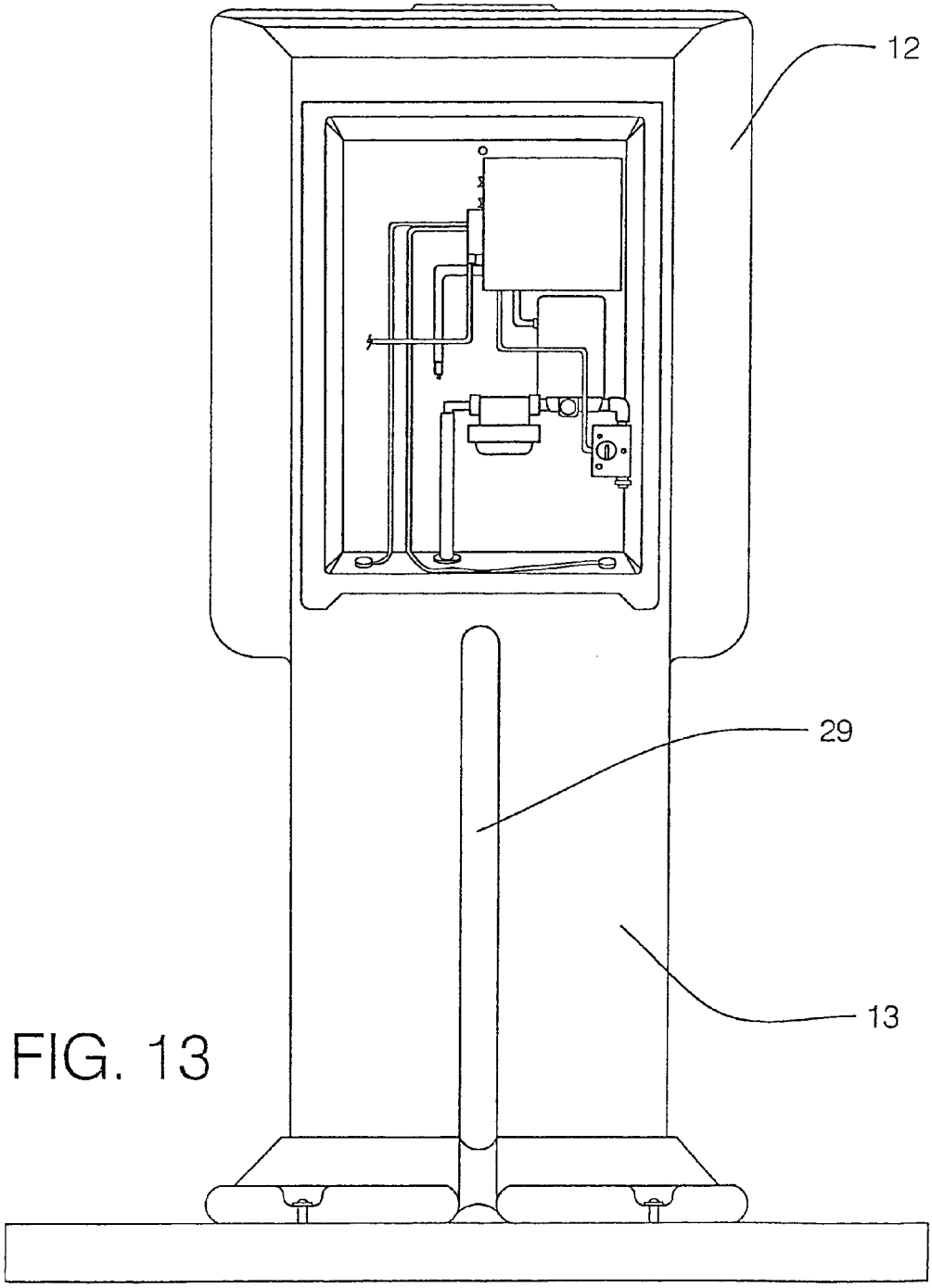
FIG. 13 is a front view of an alternate embodiment of the present invention with the cover member removed.
Figure 14:
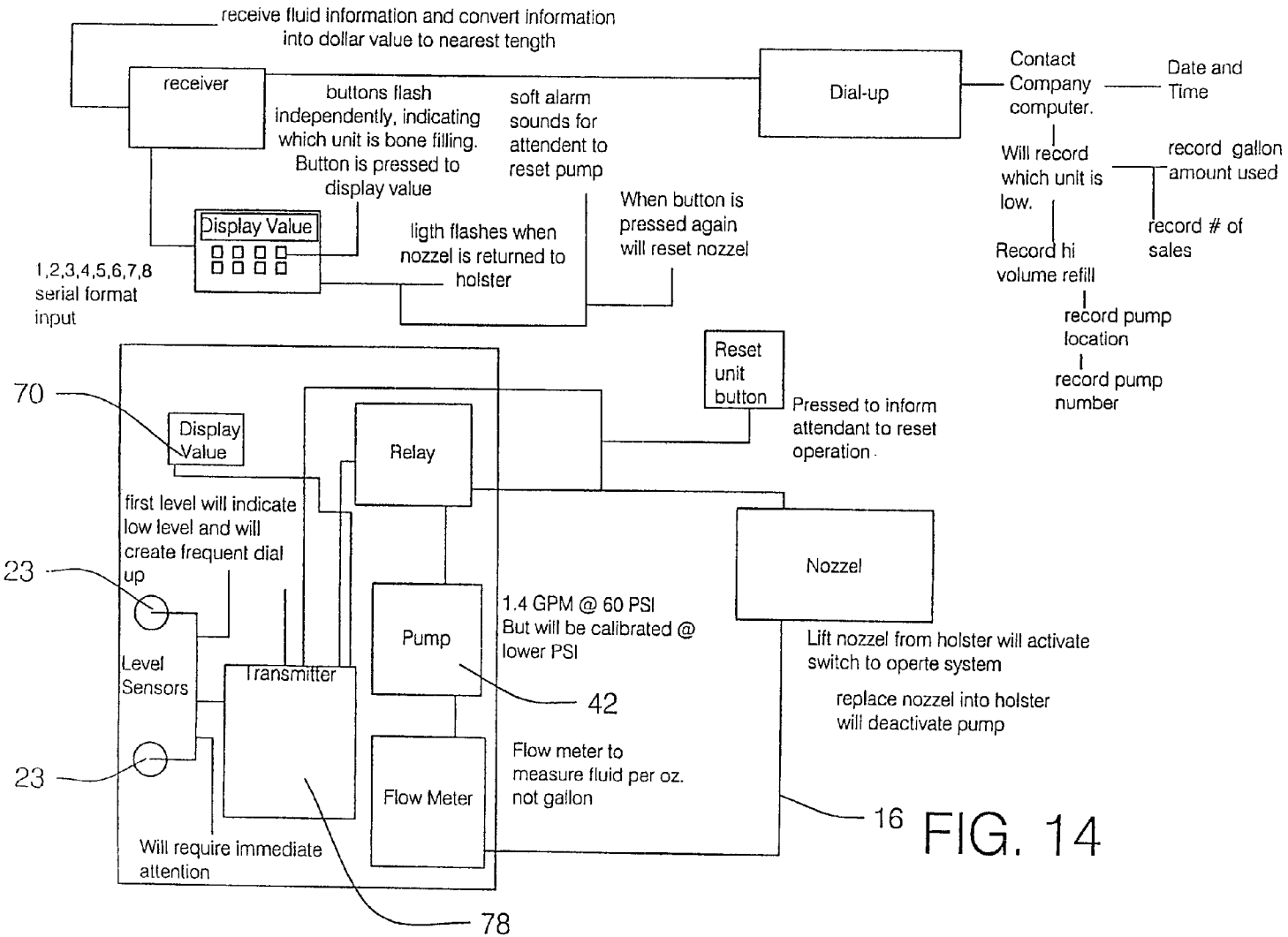
FIG. 14 is a schematic view of the operation of the present invention.
Figure 15:
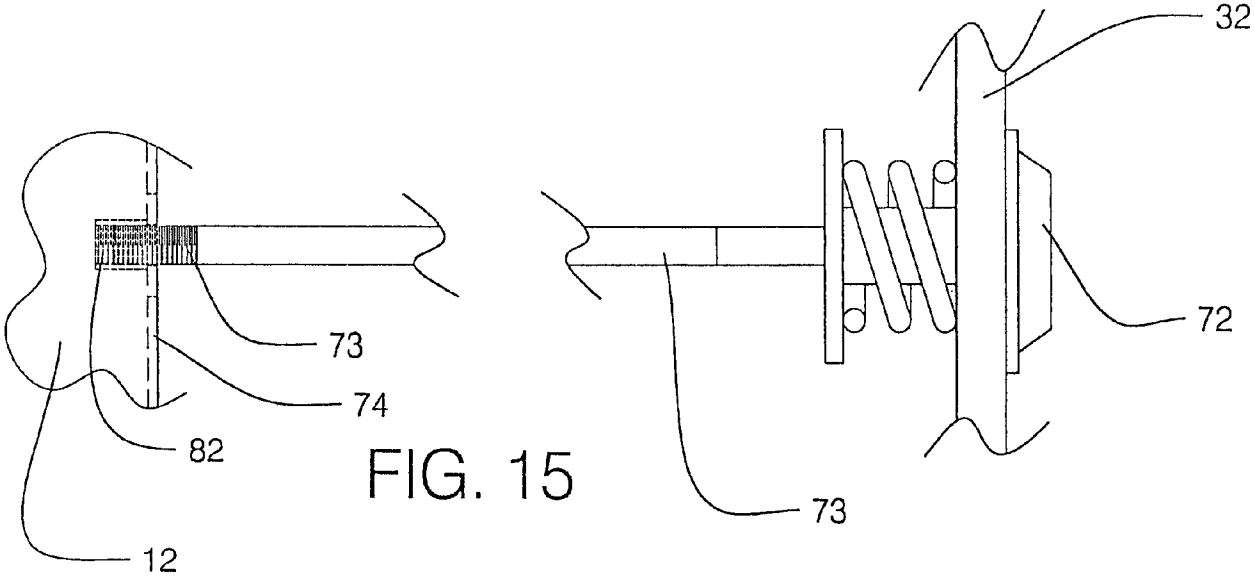
FIG. 15 is an enlarged view of the spindle lock of the present invention.
Figure 16:
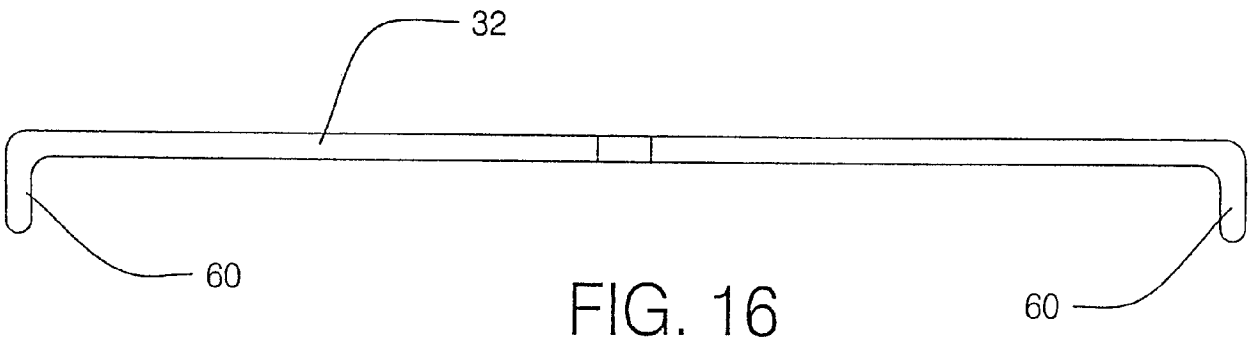
FIG. 16 is a top view of the cover member of the present invention.
Figure 17:
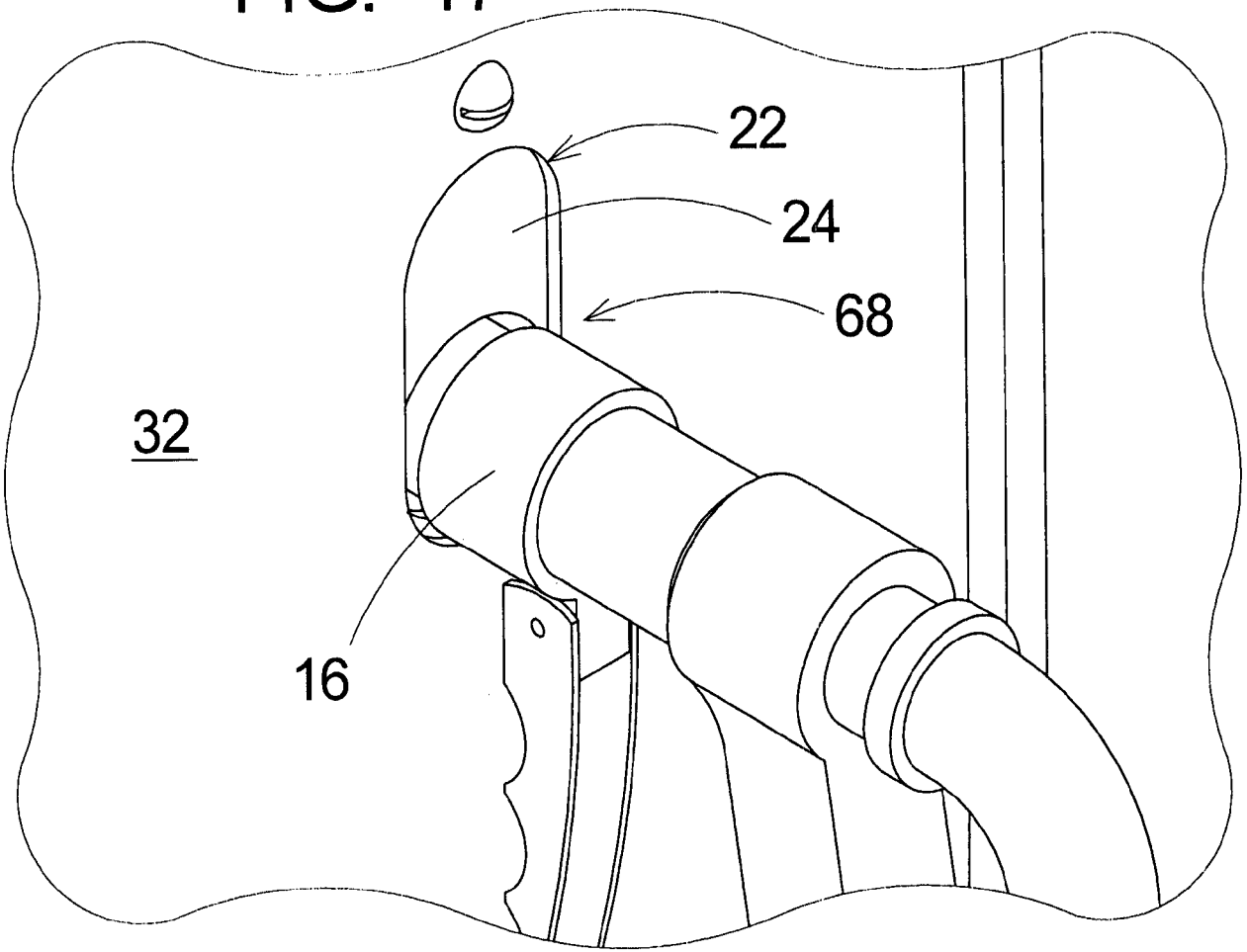
FIG. 17 is a perspective view of the dispensing hose inserted into the holster of the present invention.
Figure 18:
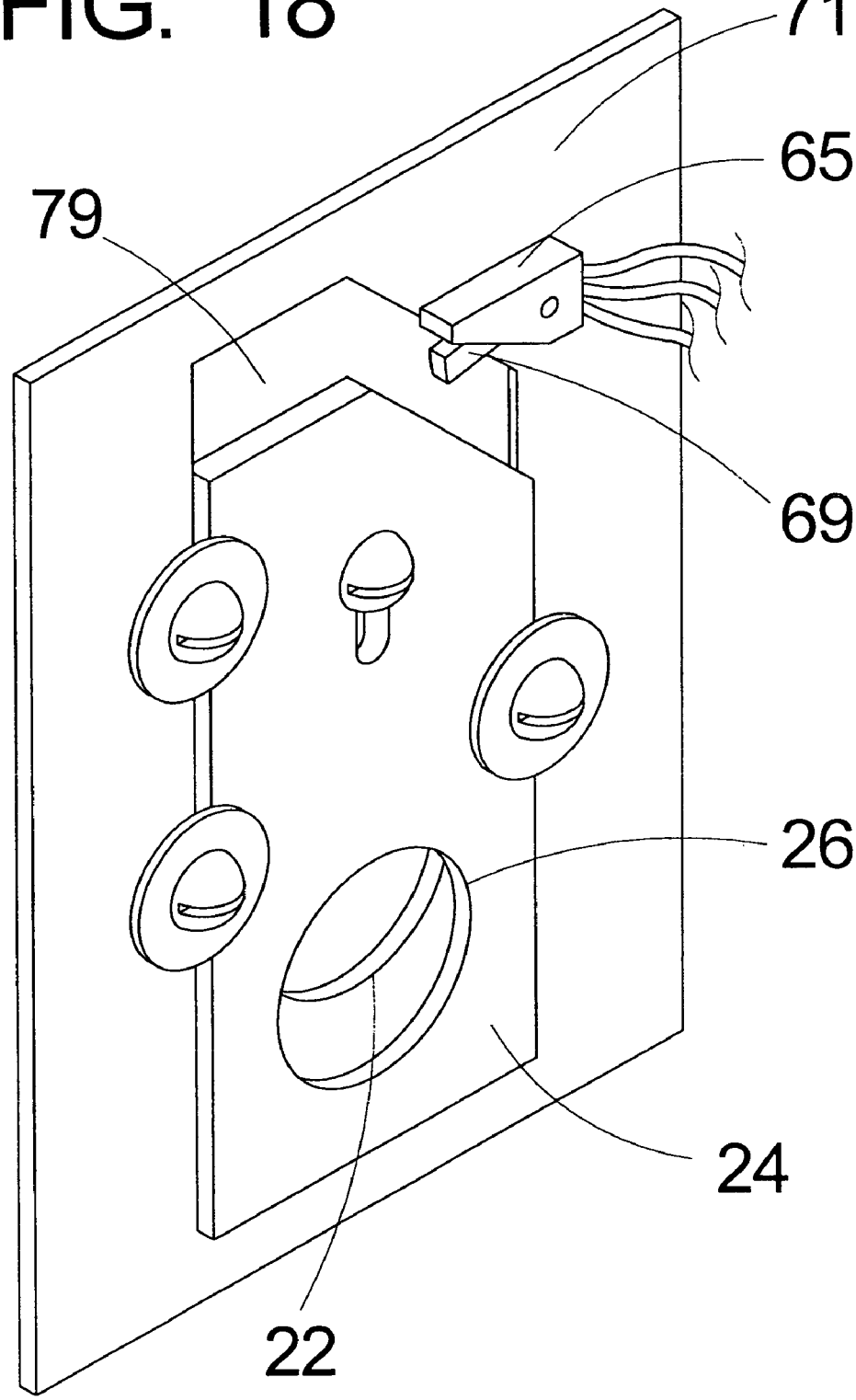
FIG. 18 is a rear view of the cover member showing the holster switch assembly in a use position.
Figure 19:
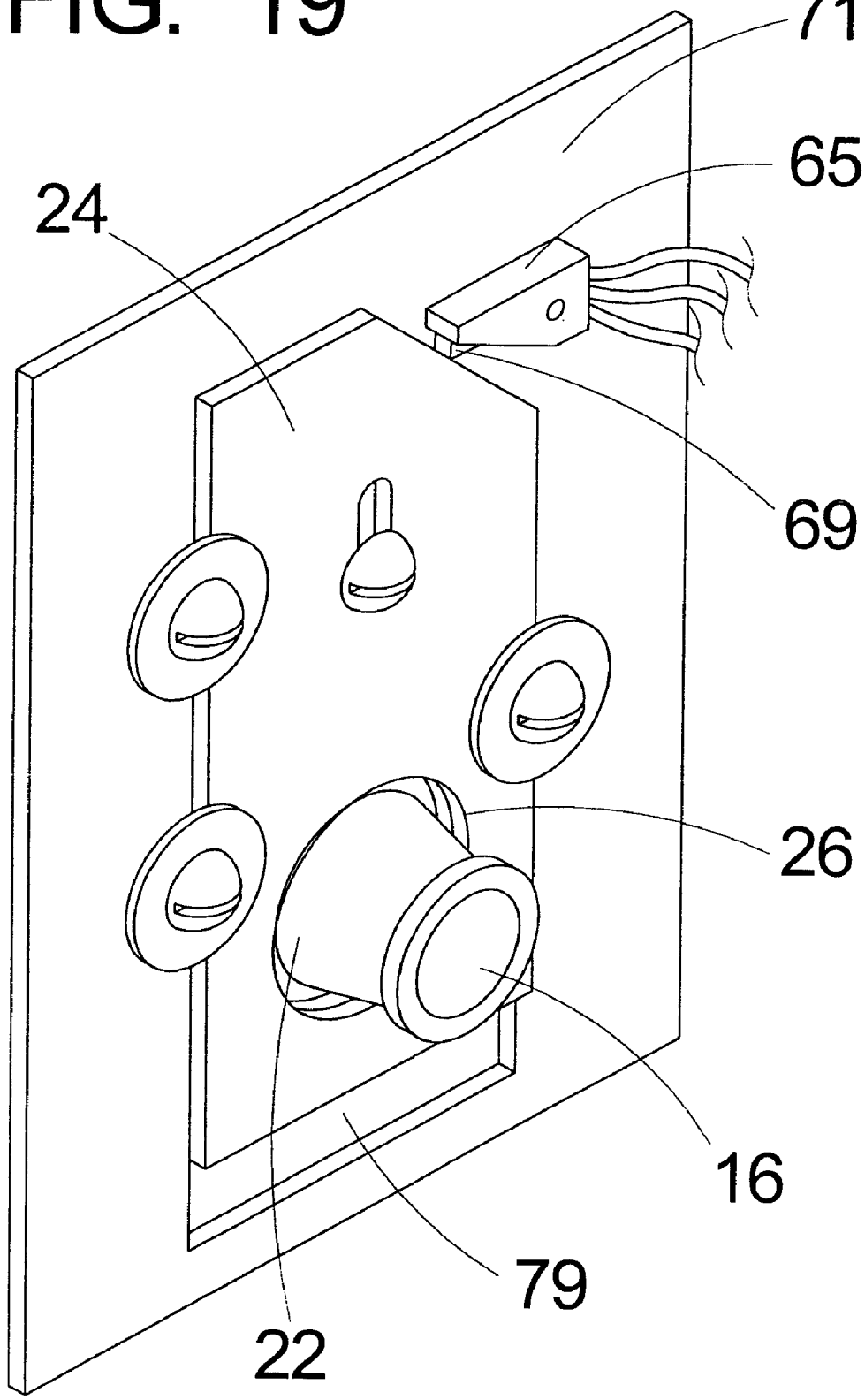
FIG. 19 is a rear view of the cover member showing the holster switch assembly in a shutoff position.

In an embodiment, the control assembly 20 includes an electronic connection port 53. A wire 55 is coupled between the pump assembly 40 and the control assembly 20. Thus, the pump 42 is activatable by the control assembly 20. The wire 55 has a first end 57 removably insertable into the electronic connection port 53 for facilitating replacement of the control assembly 20 in the event the control assembly 20 breaks down. Most preferably parts as shown in FIG. 4 are coupled to the cover member 32 to permit replacement these parts as a single unit to facilitate replacement of these parts. Typically, other parts or combinations of parts may also be coupled to the cover member to permit easy replacement.

In a first free standing embodiment utilizing attachment to an outside power source, a base portion 13 is integrally coupled to the housing 12 for supporting the housing 12 above a surface on which the base portion 13 rests. The base portion 13 includes a channeled rib 29 extends upward from a bottom of the base portion 13. An electrical wire conduit 35 for enclosing electrical wiring is positioned substantially within the channeled rib 29 and has an upper end 29A extending into the housing 12. The base portion 13 may also be an integral portion of the tank to provide additional fluid holding capacity.

Figure 20:
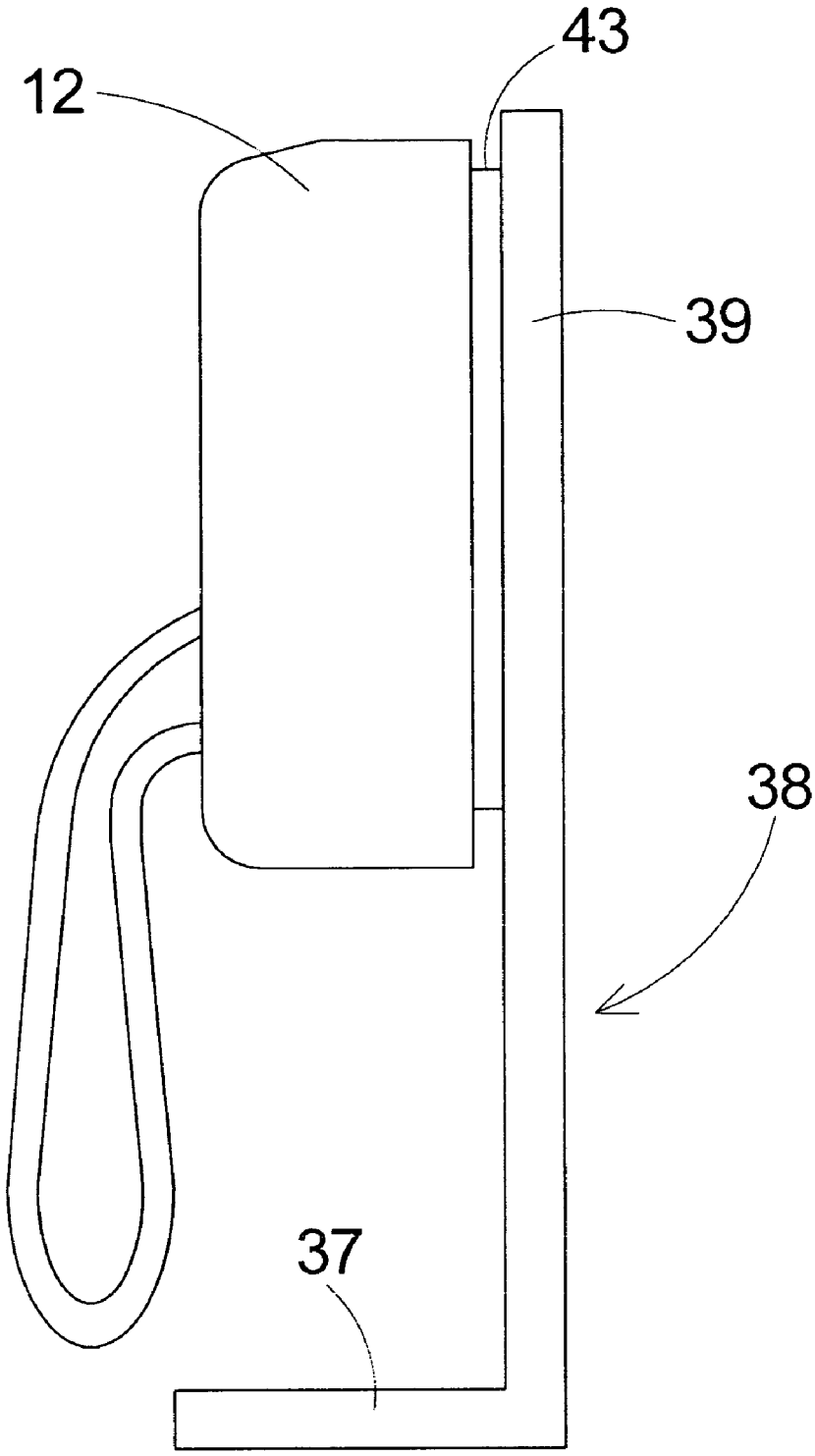
FIG. 20 is a perspective view of the portable freestanding base assembly of the present invention.
Figure 21:
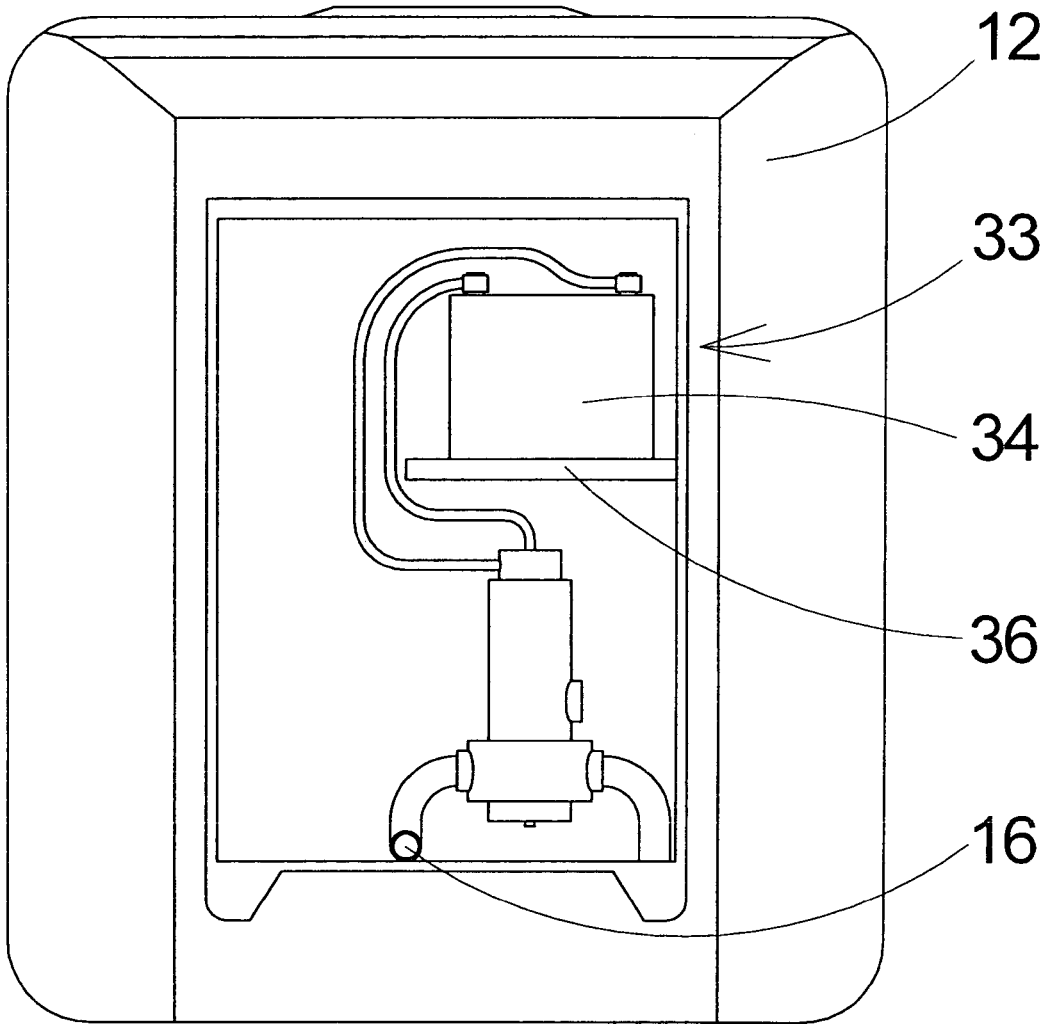
FIG. 21 is a front view of the housing with the cover member removed to show the self-contained power source.

In another portable freestanding embodiment as shown in FIG. 20, the housing 12 and tank 14 are self-contained. The power source 33 includes a 12 volt direct current battery 34 is provided on a shelf 36 within the housing 12. The power source 33 is operationally coupled to the control assembly 20 and the pump assembly 40. The housing is attached to a portable stand member 38 having a base section 37 and an elevated portion 39. The housing is attached to the elevated portion of the stand member 38 using a main mounting bracket 43.

The main mounting bracket 43 is designed for coupling to the stand member 38 or to an existing surface to provide maximum flexibility in use. The housing 12 is coupled to the main mounting bracket 43. The main mounting bracket 43 includes a medial portion 45 designed for coupling to an outer surface of a structure. The main mounting bracket 43 further includes a pair of outer portions 47 extending from the medial portion 45. The outer portions 47 are coupled to the housing 12.

In an embodiment, the medial portion 45 of the main mounting bracket 43 includes a pair of planar outside portions 49 and a recessed central portion 51 between the planar outside portions 49. The central recessed portion 51 includes a pair of spaced vertical parallel structure bracket walls 56 extending from the planar outside portions 49. Thus, the central recessed portion 51 is designed for receiving a generally rectangular shaped structure. In another embodiment, the recessed central portion 51 has an arcuate curvature. Thus, the central recessed portion 51 is designed for receiving a generally arcuately shaped outer face of the structure. The elevated portion 39 of the stand member 38 may be shaped to provide either of the described shapes to permit attachment of the main mounting bracket 43 to the elevated portion 39 of the stand member 38.

Although a spray can be provided, a flow restrictor or other conventional means may be provided to limit the flow of fluid through the dispensing hose to prevent overspray or other misuse resulting from forceful spraying of the vehicle fluid.

In use, the user inserts currency into the currency collection assembly which activates the timer for a time remaining or the computer controller for a number of pulses associated with an amount of vehicle fluid. The time remaining or amount remaining is displayed so that the user is aware of amount of time or fluid left for dispensing. The control assembly also activates the pump assembly upon the insertion of currency. The user then uses the dispensing hose to dispense the vehicle fluid, for example filling the windshield washer fluid reservoir. The user can then add more currency to the currency collection assembly for additional time or replace the dispensing hose in the holster portion of the cover member, thus deactivating the system.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered;

a holster assembly coupled to said housing for receiving a free end of said dispensing hose;

said holster assembly including a holster opening for receiving said free end of said dispensing hose and a sliding panel, said sliding panel being movable between a receiving position and a blocking position, said blocking position being for at least partially blocking said holster opening whereby insertion of said free end of said dispensing hose is prevented until said sliding panel is moved from said blocking position.

2. The fluid dispensing system of claim 1, further comprising:

said holster portion including a holster switch, said holster switch being operationally coupled to said sliding panel and said control assembly for preventing dispensing of said vehicle fluid when said sliding panel is in said receiving position.

3. The fluid dispensing system of claim 2 wherein said free end of said dispensing hose supports said sliding panel in said receiving position when said free end of said dispensing hose rests in said holster opening.

4. The fluid dispensing system of claim 1 wherein said sliding panel is vertically oriented whereby gravity urges said sliding panel into said blocking position.

5. The fluid dispensing system of claim 1 wherein said sliding panel is coupled to an interior of said cover member.

6. The fluid dispensing system of claim 1 wherein said sliding panel has an arcuate edge, said arcuate edge extending across said holster opening such that said sliding panel partially blocks said holster opening when said sliding panel is in said blocking position.

7. The fluid dispensing system of claim 2 wherein said holster switch further comprises:

a main portion positioned adjacent to said sliding panel;

a switch arm extending from said main portion, said switch arm being operationally coupled to said sliding panel such that movement of said sliding panel between said moves said receiving position and said blocking position moves said switch arm between a use position and a shutoff position, said switch arm being in said use position when said sliding panel is in said blocking position to permit activation of said pump assembly and use of said dispensing hose when said sliding panel is in said blocking position.

8. The fluid dispensing system of claim 1, further comprising:

a guide member statically positioned on an interior face of said cover member; and said sliding panel being secured to slide within a medial cutout portion of said guide member.

9. The fluid dispensing system of claim 8, further comprising:

a plurality of washers secured to said guide member by tension screws, said washers being positioned for securing said sliding panel within said medial cutout portion of said guide member.

10. A fluid dispensing system comprising:

a housing;

a tank positioned on said housing, and having an interior space adapted for holding a vehicle fluid;

a dispensing hose assembly coupled to said tank, said dispensing hose assembly including a dispensing hose having a first end in environmental communication with said interior space of said tank for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a holster assembly coupled to said housing for receiving a free end of said dispensing hose;

said holster assembly including a holster opening for receiving said free end of said dispensing hose and a sliding panel, said sliding panel being movable between a receiving position and a blocking position, said blocking position being for at least partially blocking position, said blocking position being for at least partially blocking said holster opening whereby insertion of said free end of said dispensing hose is prevented until said sliding panel is moved from said blocking position; and a main mounting bracket coupled to said housing;

wherein said main mounting bracket includes a medial section having opposite ends, a pair of transition sections each having an outer end, and a pair of outside sections, each transition section of said pair of transition sections extending from one end of the ends of said medial section, each outside section of said pair of outer sections extending from the outer end of one of said transition sections;

wherein each of said outside sections are positioned in substantially the same plane;

wherein each of said outer sections are oriented substantially parallel to said medial section;

wherein said pair of transition sections converge toward each other toward said medial section and diverge away from each other toward said outer sections.

11. The fluid dispensing system of claim 10 wherein said main mounting bracket further including a pair of outer sections extending from said outside sections, said outer sections being coupled to said housing.

12. The fluid dispensing system of claim 10, further comprising:

a portable stand member having a base portion and an elevation portion, said main mounting bracket being coupled to said elevation portion of said stand member such that said housing and stand member are free-standing for positioning at a desired location.

13. The fluid dispensing system of claim 1 further comprising:

a display panel coupled to said cover member, said display panel being operationally coupled to said control assembly for displaying a remaining time for dispensing said vehicle fluid.

14. The fluid dispensing system of claim 10, further comprising:

a power source self-contained within said housing, said power source being operationally coupled to said control assembly and said pump assembly, said power source including a 12 volt direct current battery positioned within said housing.

* * * * *